US007353809B2

(12) United States Patent
Peterson et al.

(10) Patent No.: US 7,353,809 B2
(45) Date of Patent: Apr. 8, 2008

(54) EVAPORATIVE EMISSIONS CANISTER WITH INTEGRAL LIQUID FUEL TRAP

(75) Inventors: Alicia Peterson, Rochester Hills, MI (US); Christopher D. Allen, Eastpointe, MI (US); Anthony R. St. Amour, Dearborn Heights, MI (US); John M. Hamilton, Grand Blanc, MI (US)

(73) Assignee: Fluid Routing Solutions, Inc., Rochester Hills, MI (US)

( * ) Notice: Subject to any disclaimer, the term of this patent is extended or adjusted under 35 U.S.C. 154(b) by 60 days.

(21) Appl. No.: 11/592,973

(22) Filed: Nov. 3, 2006

(65) Prior Publication Data

US 2007/0051346 A1 Mar. 8, 2007

Related U.S. Application Data

(63) Continuation-in-part of application No. 10/655,240, filed on Sep. 3, 2003, now abandoned.

(51) Int. Cl.
*F02M 37/04* (2006.01)

(52) U.S. Cl. ..... 123/516; 123/519; 96/134

(58) Field of Classification Search ..... 123/520, 123/519, 518, 516; 96/134, 135, 136; 55/385.3
See application file for complete search history.

(56) References Cited

U.S. PATENT DOCUMENTS 2,323,525 A * 7/1943 Houstle, Jr. et al. ..... 96/210
4,168,687 A * 9/1979 Kurahashi et al. ..... 123/510
4,203,401 A 5/1980 Kingsley et al.
4,283,401 A 8/1981 Szantay et al.
4,658,796 A 4/1987 Yoshida et al.
5,072,713 A 12/1991 Sweeten
5,119,791 A 6/1992 Gifford et al.
5,408,977 A 4/1995 Cotton
5,456,236 A 10/1995 Wakashiro et al.
5,456,237 A 10/1995 Yamazaki et al.
5,460,136 A 10/1995 Yamazaki et al.
5,477,936 A 12/1995 Sugioka et al.
5,511,957 A 4/1996 Tuckey et al.
5,651,349 A 7/1997 Dykstra et al.
5,776,228 A * 7/1998 Meiller et al. ..... 96/134
5,910,637 A * 6/1999 Meiller et al. ..... 96/135
5,924,410 A 7/1999 Dumas et al.
5,957,114 A 9/1999 Johnson et al.
6,136,075 A 10/2000 Bragg et al.
6,237,574 B1 5/2001 Jamrog et al.
6,302,144 B1 10/2001 Graham et al.
6,321,726 B1 * 11/2001 Khami et al. ..... 123/519

(Continued)

*Primary Examiner*—Carl S. Miller
(74) *Attorney, Agent, or Firm*—Joseph V. Tassone; J. Daniel Lykins

(57) ABSTRACT

An evaporative emissions canister is used in an automotive evaporative emission system to separate liquid fuel entrained with fuel vapor and to control emission of fuel vapors to the atmosphere, the system including a fuel tank coupled to an automotive engine. The canister includes an integrally molded housing having side walls, a top wall and a bottom wall; a hydrocarbon-adsorbing material disposed therein so as to provide a vapor adsorbent chamber for adsorbing hydrocarbon fuel vapor flowing therethrough; and a liquid-fuel trap located above the vapor adsorbent chamber for separating fuel vapor and liquid fuel. A method is provided for preventing or reducing hydrocarbon emissions to the atmosphere.

24 Claims, 2 Drawing Sheets

U.S. PATENT DOCUMENTS 6,343,590 B1 2/2002 Nagai et al.
6,374,811 B1 4/2002 Mancini
6,425,380 B2 * 7/2002 Yamada et al. ..... 123/519
6,834,642 B2 12/2004 Ichinohe
7,051,717 B2 5/2006 Meiller et al.
2002/0007826 A1 1/2002 Yamada et al.

* cited by examiner

EVAPORATIVE EMISSIONS CANISTER WITH INTEGRAL LIQUID FUEL TRAP

This application is continuation-in-part of U.S. patent application Ser. No. 10/655,240, filed Sep. 3, 2003 now abandonded.

BACKGROUND OF THE INVENTION

The present invention relates to a fuel system for an internal combustion engine and, particularly, to a method and an evaporation emissions canister which includes an integral liquid fuel trap for improved separation of liquid fuel which is entrained along with the fuel vapor from the fuel tank to the evaporative emissions canister in the fuel system.

Presently, fuel systems employed in the automotive industry contain an evaporative emissions canister to control evaporative emissions from the automotive fuel tank. Examples of evaporative emissions canisters are described in U.S. Pat. No. 4,203,401 to Kingsley et al.; U.S. Pat. No. 4,658,796 TO Yoshida et al.; U.S. Pat. No. 4,683,862 to Fornuto et al.; U.S. Pat. No. 5,119,791 to Gifford, et to Cotton; U.S. Pat. No. 5,924,410 to Dumas et al.; U.S. Pat. No. 5,957,114 to Johnson et al; U.S. Pat. No. 6,136,075 to Bragg et al; U.S. Pat. No. 6,237,574 to Jamrog et al.; and RE38, 844 to Hiltzik et al.

Typically, the evaporative emissions canisters include an adsorbent material such as activated carbon to adsorb the fuel vapors emitted from the fuel tank. The carbon filled canister adsorbs the fuel vapor until it becomes saturated, at which time, fresh air drawn through the canister removes the fuel vapor therefrom and sends it to the engine by means of suitable conduits and flow control devices. Such fuel systems not only permit the vapor to flow to the canister but also have the potential to allow liquid fuel entrained with the fuel vapor to travel from the fuel tank to the canister where it saturates at least a portion of the adsorbent carbon bed causing the carbon to become non-functional until the liquid is evaporated and purged from the carbon bed. This decreases the overall working capacity of the adsorbent material and the efficiency of the canister resulting in possible emissions to the atmosphere. To prevent this, some fuel systems incorporate a device inside the fuel tank where the liquid fuel is trapped and returned to the tank. Such devices are not entirely satisfactory since small amounts of liquid fuel are entrained with the fuel vapor and enter the emissions canister where it has the potential to reduce the effectiveness of the emissions canister. Emissions canisters have been provided with a liquid fuel trap, which is designed to allow the liquid fuel to enter the canister but will not allow it to enter the adsorbent material bed. Once the liquid enters the liquid fuel trap it simply sits there until it either evaporates on its own due to the properties of the gasoline or it will be drawn out of the canister during the purge cycle of the vehicle and conveyed back to the engine where it is consumed. However, such canisters generally require that an additional welding step be performed in the manufacture of the canister/liquid fuel trap system, wherein a seal is created between the fuel trap and the canister. Typically, the fuel trap is installed into the canister via a plastic welding process such as vibration welding, ultrasonic welding, etc. The manufacture of such evaporative emissions canisters is both time consuming and economically unattractive.

Typically, evaporative emissions canisters with incorporated liquid fuel traps have been manufactured by mounting the liquid fuel trap into of the canister, providing a basin for any invasive liquid fuel. For example, U.S. Pat. No. 5,119,791 to Gifford, et al. specifically teaches the use of a liquid trap with a vapor storage canister wherein the liquid-fuel trap consists of a cup that forms an interior cavity at the bottom of, and surrounded by, the carbon adsorbent bed. The fuel vapor with entrained liquid fuel emitted from the fuel tank is directed to the liquid-fuel trap through a fill tube. The liquid fuel settles out in the cup where it remains until it is later vaporized. The fuel vapor enters the carbon bed through a grid. During purge, vacuum is applied to a central purge tube that extends all the way through the carbon bed and cup into a plenum located below the cup. It is apparent from the above that there exists a need in the art for an automotive evaporative emissions canister which effectively prevents liquid fuel from entering and saturating the carbon bed in the canister, and which also eliminates the requirement for an additional sealing step between the fuel separator and the canister in the manufacturing process. Furthermore, it is desirable to provide an evaporative emissions canister having a simple construction, which does not require the insertion of the associated tubes all the way into the chambers of the evaporative emissions canister.

SUMMARY OF THE INVENTION

In accordance with the present invention, the liquid-fuel trap is incorporated into the evaporative emissions canister body by simply pressure fitting the liquid-fuel trap into an open chamber located directly above the adsorbent chamber in the canister housing. The liquid-fuel trap, when incorporated into the evaporative emissions canister in accordance with the invention, as described below, directs the liquid fuel to the liquid-fuel trap by gravity while allowing the fuel vapor to flow to the adsorbent material where it is adsorbed and stored until it is purged to the engine where it is consumed. Since the liquid-fuel trap is secured in the evaporative emissions canister by pressure fitting the liquid-fuel trap directly into the canister housing, the need for a separate welding step is eliminated, thereby reducing labor and capital costs associated with welding equipment and operators.

Accordingly, it is a primary object of this invention to provide an improved evaporative emissions system, which incorporates a liquid-fuel trap in the fuel system, which is operative to prevent liquid fuel from entering the carbon bed.

It is another object of the invention to provide an evaporative emissions canister, which eliminates the requirement for an additional step in the manufacturing process to provide a seal between the fuel separator and the canister.

It is yet another object of the invention to simplify the manufacture of an evaporative emissions canister having a liquid-fuel trap incorporated therein, wherein the evaporative emissions canister does not require additional purge tubes that protrude all the way into and through the adsorbent chamber of the canister housing.

These objects as well as other objects, features and advantages of the present invention will be apparent to those skilled in the art from the following detailed description, appended claims and accompanying drawings.

DETAILED DESCRIPTION OF THE INVENTION

Figure 1:
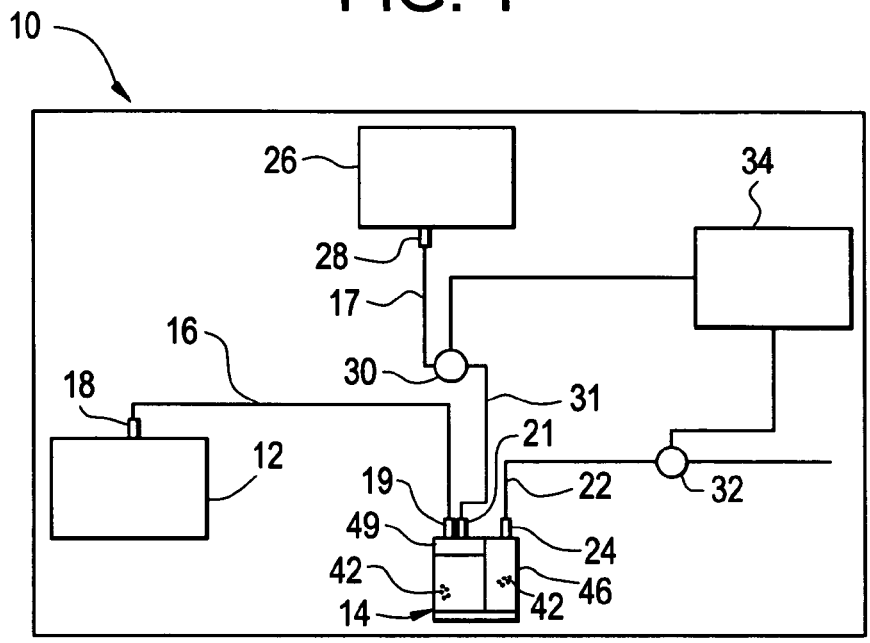
FIG. 1 is a schematic illustration of an evaporative emission system of a combustion engine in accordance with the present invention.

Vehicle fuel systems require liquid traps to prevent liquid fuel from entering the carbon bed of the vapor canister. Without the liquid trap, there is the potential for liquid fuel to enter the adsorbent bed in the canister where the adsorbent material would quickly degrade to a point that it would no longer be useful.

It has now been found that an evaporative emissions canister manufactured in accordance with the present invention and positioned between the fuel tank and the engine of an automotive vehicle, effectively separates the fuel vapor from any liquid fuel entrained therewith. More specifically, the evaporative emissions canister of the present invention incorporates a liquid-fuel trap directly into the housing of the evaporative emissions canister, wherein the liquid-fuel trap is disposed above the adsorbent chamber containing the adsorbent material so that the fuel vapor and any accompanying liquid fuel are in open communication with the liquid-fuel trap without the need for any additional tubular hardware to direct the fuel vapor and the liquid fuel to other destinations within the evaporative emissions canister. As more fully described below, the liquid fuel is separated from the fuel vapor immediately upon entering the evaporative emissions canister providing a simpler and more effective separation of the liquid fuel vapor from the fuel vapor.

The evaporative emission canister of the invention includes a first chamber for receiving a mixture of fuel vapor having liquid fuel entrained therewith. The first chamber comprises:

a top member having an inner surface and an outer surface, the top member terminating in a circumferential edge thereof defining a circumferential perimeter of the top member. The first chamber further includes a continuous side member having an inner surface and an outer surface, said side member extending vertically from the circumferential edge of the top member in a downward direction defining a first cavity for receiving a mixture of fuel vapor having liquid fuel entrained therewith;

a first tubular member extending upwardly from said housing and in operable communication with said fuel vapor-receiving chamber, said first tubular member providing a passage throughwhich said fuel vapor having said liquid fuel entrained therewith flows into said fuel vapor-receiving chamber;

a first port in operable communication with the first chamber, the first port extending upwardly from the top of the first chamber in an oppositional direction from the continuous side member and provides a passageway through which the fuel vapor having liquid fuel entrained therewith flows into said first chamber;

a second tubular member extending upwardly from said housing and in operable communication with said fuel-receiving chamber, said second tubular member providing a passage throughwhich fuel vapor flows from said evaporative emissions canister to an automotive engine where said fuel vapor is consumed;

a second port in operable communication with the first chamber, the second port extending upwardly from the top member of the first chamber and parallel to the first port providing a passageway through which fuel vapor flows from the evaporative emissions canister to an automotive engine where the fuel vapor is consumed; and a circumferential groove formed in the inner surface of the top member, the circumferential groove being parallel to the circumferential edge of the top member.

The evaporative emissions canister further comprises a second chamber positioned below the first chamber and in open communication with the first chamber, the second chamber comprises:

a bottom member defining the lower perimeter of the second chamber;

a continuous side member having an inner surface and an outer surface extending vertically from the bottom member in an upward direction defining a second cavity of the evaporative emissions canister;

a second top member adjacent the first chamber;

a partition extending downwardly to a predetermined distance from the second top member dividing the second chamber into a first compartment and a second compartment, the first compartment being directly below and in open communication with the first chamber, and the second compartment being directly below the second top member;

a third tubular member extending upwardly from said housing, said third tubular member providing a passage throughwhich fresh air is admitted to said housing during a purging stet, and throughwhich air from an air/fuel mixture is vented to the atmosphere in a venting step;

a third port in operable communication with the second chamber, the third port extending upwardly from the second top member providing a passageway through which fresh air from the second compartment is vented to the atmosphere upon adsorption of fuel vapor from the liquid fuel trap, and for permitting air to flow into the second compartment upon desorption of fuel vapor from the first compartment, during a purging step; and a liquid-fuel trap located in the first chamber for separating liquid fuel from fuel vapor and retaining the liquid fuel until it is evaporated forming additional fuel vapor.

The liquid-fuel trap comprises:

a second bottom member;

a continuous side member defining a circumferential wall having an inner surface, an outer surface and a rim defining the upper edge of the continuous side member, the continuous side member extending vertically from the bottom member in an upward direction;

a plurality of parallel rib members extending vertically along at least a portion of the outer surface of the continuous side member of the liquid-fuel trap wherein the liquid-fuel trap is secured in the first chamber by pressure exerted by the plurality of ribs on the interior surface of the sidewall of the first chamber to secure the liquid-fuel trap in the first chamber. The ribs are spaced apart exhibiting open access between each of the ribs to allow the flow of fuel vapor from the first chamber to the second chamber. The circumferential upper rim of the side member of the liquid-fuel trap is inserted into the corresponding circumferential groove in the inner surface of the top of the first chamber to provide a seal thereat. Since the canister is typically installed on its side in the vehicle, the seal prevents the liquid fuel from entering the second chamber while allowing the fuel vapor to flow freely to the second chamber through the opening in the bottom of the liquid-fuel trap. The liquid fuel remains in the liquid-fuel trap until it evaporates and subsequently passes as fuel vapor into the adsorbent chamber, or is purged along with the adsorbed fuel vapor into the automotive engine where it is consumed. In a particularly preferred aspect of the present invention, each of said first, second and third ports is an external port and there is no need for additional tubular purge member extending through the adsorbent material and to the bottom of the adsorbent chamber of the evaporative emissions canister.

Turning to the drawings, FIG. 1 is a schematic illustration of an evaporative emissions system for an automotive vehicle. As illustrated in FIG. 1, the evaporative emissions system 10 includes an evaporative emissions canister 14 containing a bed of adsorbent material 42. Fuel vapor including a small amount of liquid fuel vented from the fuel tank 12 flows through the fuel vapor line 16 which communicates with fuel tank 12 via port 18 and with canister 14 via port 19. Fuel vapor containing anywhere from a minor amount to a relatively significant amount of liquid fuel is vented from the fuel tank 12 where it flows through fuel vapor line 16 to the canister 14. In accordance with the present invention, the liquid fuel is separated from the fuel vapor allowing the fuel vapor to be adsorbed by the bed of adsorbent material 42. The adsorbed fuel vapor is then purged from the adsorbent material 42 as necessary by applying engine vacuum on the bed of adsorbent material 42, drawing air through the adsorbent material 42 containing the fuel vapor. The desorbed fuel vapor is then fed to the engine 26 through engine vacuum line 17, and consumed. More specifically, one end of the fuel vapor load line 16 is connected to the fuel tank 12 via port 18 and the other end is connected to the canister 14 via port 19. The fuel vapor, including a minor amount of liquid fuel enters the canister at port 19 where the fuel vapor is separated from any liquid fuel entrained therewith. Upon entering the evaporative emissions canister 14, the liquid fuel is directed by gravity into the liquid-fuel trap 48 where it remains until it evaporates, while the fuel vapor is passed on to the adsorbent chamber 46 where it is adsorbed on the adsorbent material 42. The liquid fuel, upon evaporation, may pass into the adsorbent chamber where it is adsorbed on the adsorbent material, or it may pass directly to the engine 26 for consumption along with the adsorbed fuel vapor from the adsorption chamber 46 during a purge step.

When the adsorbent material 42 becomes saturated with the fuel vapor, engine controller 34 commands fuel vapor valve 30 to close the fuel vapor load line 16 so that the fuel vapor is desorbed from the adsorbent material 42 and drawn by vacuum through an engine vacuum port 28 connecting engine vacuum line 17 to the engine 26 where the desorbed fuel vapor is consumed. The vacuum created by opening the fresh air valve 32 also causes fresh air from the atmosphere to be drawn into the canister 14 through fresh air line 22 connected to canister 14 via port 24. Upon removal of the fuel vapor from the adsorbent material 42, the fuel vapor valve 30 is opened so that additional fuel vapor from the fuel tank 12 can be transported via fuel vapor load line 16 to the canister 14 and adsorbed by the adsorbent material 42. Fresh air is then forced back through fresh air line 22 to the atmosphere. The fresh air valve 32 is opened and closed by the engine controller 34 to prevent fuel vapor from escaping into the atmosphere. However, the fresh air valve 32 typically remains open until routine or diagnostic steps are performed on the automotive vehicle.

Figure 2:
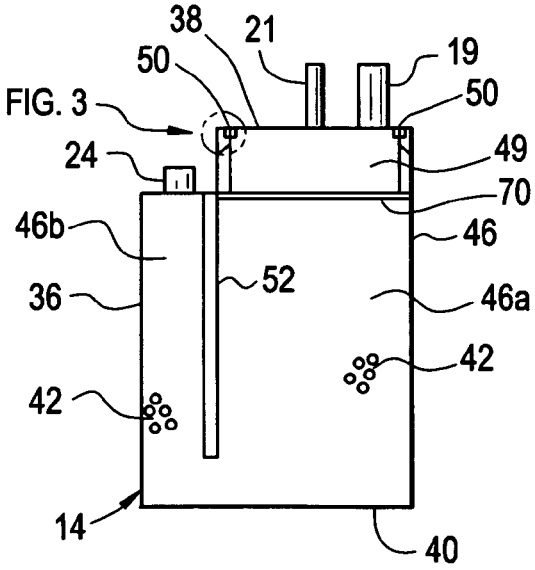
FIG. 2 is a side view of an evaporative emissions canister of the evaporative emissions systems of FIG. 1.
Figure 3:
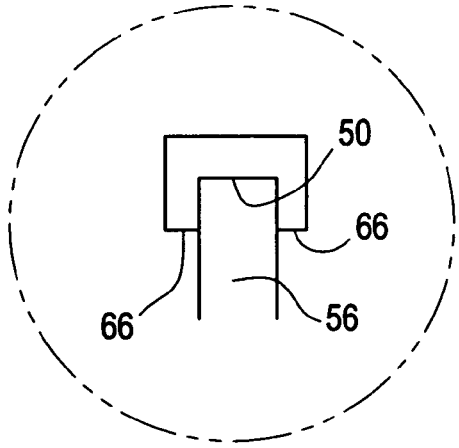
FIG. 3 is an enlarged view of Section A of FIG. 2.
Figure 4:
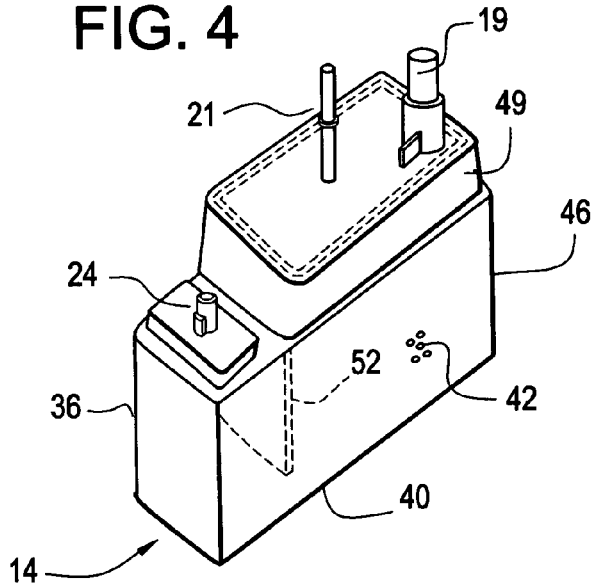
FIG. 4 is a perspective view of the evaporative emissions canister of the invention.
Figure 5:
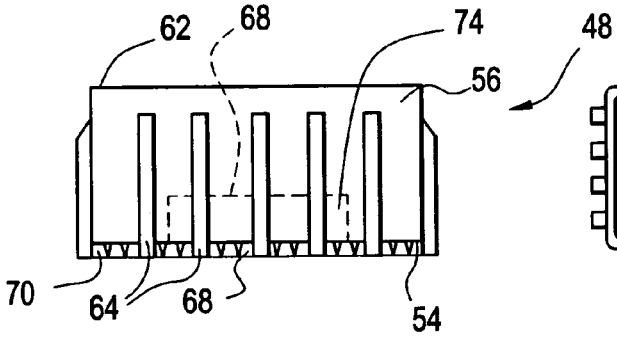
FIG. 5 is a perspective view of a liquid-fuel trap of the present invention.
Figure 6:
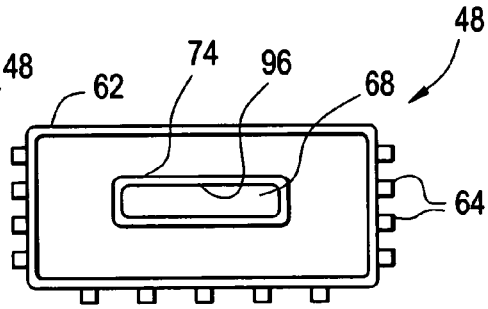
FIG. 6 is a side view of a liquid-fuel trap of the present invention.
Figure 7:
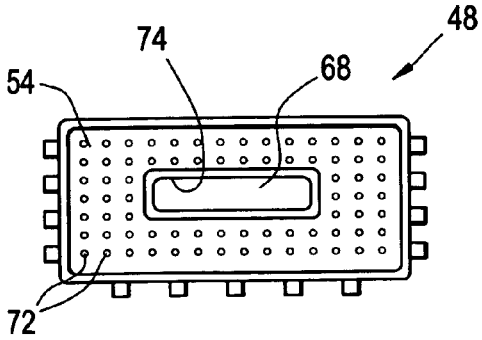
FIG. 7 is a top view of the liquid-fuel trap of FIG. 4.
Figure 8:
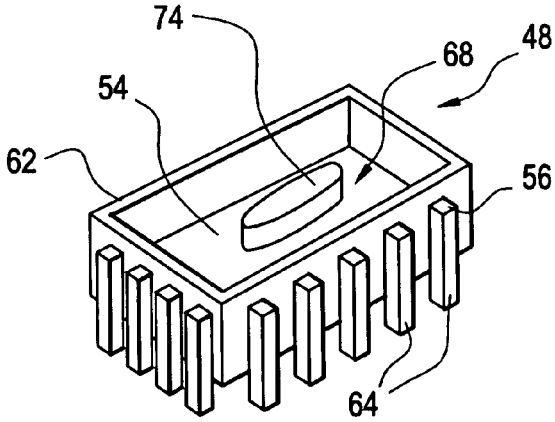
FIG. 8 is a bottom view of the liquid-fuel trap of FIG. 4.

As shown in FIG. 2, the canister 14 includes a housing having a side portion 36, a top portion 38 and a bottom portion 40. The canister 14 further includes a liquid fuel trap 48 secured in a fuel vapor-receiving chamber 49 located above the adsorbent chamber 46. The adsorbent chamber 46 includes a partition 52 that divides the adsorbent chamber into two compartments 46*a* and 46*b*, both of which contain adsorbent material 42. The adsorbent material 42 in the first compartment 46*a*, which is located directly below the first chamber, adsorbs and stores the fuel vapor as it enters the compartment 46*a*. During a purge step, the fuel vapor valve is actuated to draw fresh air from the fresh air valve through the second compartment 46*b* via port 24 where the fresh air travels through the adsorbent material 42 and around the bottom of the partition 52 displacing the fuel vapor adsorbed and stored in the compartment 46*a*. The displaced fuel vapor proceeds to the automotive engine 26 through engine vacuum line 17, where it is consumed. Fuel vapor entering the canister 14 through port 19 is passed into the adsorbent chamber 46, which contains the adsorbent material 42 while the liquid fuel accompanying the fuel vapor is drawn by gravity to the fuel trap 48 above the chamber 46. At the liquid fuel trap 48, a seal is maintained between the fuel trap 48 and the adsorbent chamber 46 by creating a torturous path for the liquid molecules via a groove 50 inside the fuel vapor-receiving chamber 49, into which the fuel trap 48 is pressed. The liquid fuel entrained with the fuel vapor from the fuel tank 12 is separated from the fuel vapor by gravity wherein the fuel vapor is directed to the adsorbent material 42 and the liquid fuel is directed to the fuel trap 48 where the liquid remains until it evaporates. Upon evaporation, the liquid fuel in the form of fuel vapor is directed into the bed of adsorbent material 42 in chamber 46 where it becomes adsorbed on the adsorbent material 42, or it is directed to the engine during the purge stage. Typically, a porous material separates the liquid-fuel trap chamber 20 from the adsorbent chamber 46 to promote even flow of the fuel vapor therethrough. As illustrated in FIG. 5, the outer surface of the bottom member 54 of the liquid-fuel trap may include a plurality of finger members 72 to further facilitate the flow of fuel vapor through the porous material 70.

The fuel tank vapor load line 16 is connected to canister 14 via port 19. Engine purge line 17 is also connected to the canister 14 via port 24. Communication between the canister 14 and each of the fuel tank 12 and the engine 26 is controlled by valve 30. When the valve 30 is open between the fuel tank 12 and the canister 14, fuel vapor from the fuel tank 12 is transported to the canister 14 and when the valve 30 is open between the canister 14 and the engine 26, desorbed fuel vapor is drawn from the adsorbed material 42 in the canister 14 via vapor line 17 having one end connected to canister port 21 and the other end connected to by engine port 28 where the desorbed fuel vapor is consumed. The engine's vacuum serves to draw fresh air through the fresh air vent line 22 into the canister 14 for the purpose of desorbing fuel vapor from the bed of adsorbent material 42. The desorbed fuel vapor is then routed to the engine 26 through fuel vapor line 17 where it is consumed by the engine 26. The air drawn into the bed of adsorbent material 42 to desorb the fuel vapor is then vented to the atmosphere through fresh air line 22 connected to the canister 14 by fresh air vent port 24.

The liquid fuel trap 48 is located above the adsorbent material chamber 46 and separates any liquid fuel, which is swept along with the fuel vapor into the canister 14. The fuel vapor separated from the liquid fuel continues on to the adsorbent material chamber 46 where it is adsorbed by the adsorbent material 42. The liquid fuel swept into the liquid fuel trap 48 is pulled there by gravity where it remains until it eventually evaporates. The vapor created by the evaporation of the liquid fuel then passes on to the bed of adsorbent material 42 where it becomes adsorbed, or it is purged to the engine 26 through fuel vapor line 17, depending on the direction of flow dictated by the engine controller 34 at the time.

The liquid fuel trap 48 comprises:

A bottom member 54 defining the bottom of the liquid-fuel trap 48; a continuous side member 56 defining a circumferential wall having an inner surface 58, an outer surface 60 and a circumferential rim 62 defining the upper edge of the continuous side member 56, the continuous side member 56 extending vertically from the bottom member 54 in an upward direction, and a plurality of parallel rib members 64 extending vertically along at least a portion of the outer surface 60 of the continuous side member 56 of the liquid-fuel trap 48 wherein the liquid-fuel trap 48 is secured in the liquid-fuel trap chamber 20 by pressure exerted by the plurality of rib members 64 on the interior surface of the sidewall 56 of the liquid-fuel trap chamber 20 to secure the liquid-fuel trap 48 in the liquid-fuel trap chamber 20. The rib members 64 are spaced apart exhibiting open access between each of the rib members to allow the flow of fuel vapor from the liquid-fuel trap chamber 20 to the adsorbent chamber 46.

In order to keep the adsorbent material 42 inside the adsorbent material chamber 46, a barrier member 70 may be disposed between the fuel vapor-retaining chamber 49 and the adsorbent chamber 46 to prevent the adsorbent material 42 from escaping the adsorbent chamber 46 and entering the fuel vapor-retaining chamber 49. Typically the barrier member 70 is a porous material such as a foamed polymeric material, a fibrous material, or the like. In order to provide a surface area and maintain the barrier member 70 relatively flat, the bottom member 54 of the liquid-fuel trap 48 includes a plurality of finger elements 72 extending downwardly from the outer surface of the bottom member 54 of the liquid-fuel trap 48 adjacent the barrier member 70.

The circumferential upper rim 62 of the side member 56 of the liquid-fuel trap 48 is inserted into the corresponding circumferential groove 50 in the inner surface of the top portion 38 of the liquid-fuel trap chamber 20 to provide a seal 66 thereat. The seal 66 prevents the liquid fuel from entering the adsorbent chamber 46 while allowing the fuel vapor to flow freely to the adsorbent chamber 46 through the aperture 68 in the bottom 54 of the liquid-fuel trap 48. The aperture 68 typically includes a wall portion 74 extending upward from the circumferential rim 76 of the aperture 68. The liquid fuel remains stored in the liquid-fuel trap 48 until it evaporates and subsequently passes as fuel vapor into the adsorbent chamber 46, or is purged along with the adsorbed fuel vapor into the automotive engine 26 where it is consumed.

The evaporative emissions canister of the present invention is manufactured from any material possessing the desirable properties and characteristics, such as flexibility, fuel resistance, heat resistance, pressure resistance, weatherability, dimensional stability, and high impact strength. Typically, such material is a polymeric material, more preferably, a polyamide material such as nylon or an aromatic polyamide such as aramid.

Typically, the evaporative emissions canister, including the various parts thereof, is molded in one piece to provide a continuous unitary structure thereby preventing the need for any assembly steps.

The liquid-fuel trap, including the various parts thereof, is also manufactured as a unitary structure, but in a separate molding operation from that of the evaporative emissions canister.

The adsorbent material useful in the invention may be any of the conventional materials effective to adsorb hydrocarbon materials such as fuel vapor. Preferable, the adsorbent material is carbon and most preferably activated carbon. The carbon can be in any desired form having an effective particle size sufficient to maximize the adsorbance of the fuel vapor in the canister.

Typically, the evaporative emissions canister will include a volume compensator, as is well known in the art, located at the bottom of the canister housing to limit shifting of the adsorbent material, particularly during operation of the automotive vehicle.

While the present invention has been fully illustrated and described in detail, other designs, modifications and improvements will become apparent to those skilled in the art. Such designs, modifications and improvements are considered to be within the spirit of the present invention, the scope of which is determined only by the scope of the appended claims.

What is claimed is:

1. An evaporative emissions canister having a liquid-fuel trap integrally disposed therein, wherein said evaporative emissions canister is incorporated into an automotive evaporative emission system to control emission of fuel vapor to the atmosphere, the system including a fuel tank coupled to an automotive engine, said canister comprising:

(a) a housing having a circumferential sidewall, a top wall shaving a circumferential groove therein, and a bottom wall, said housing comprising:

(1) a fuel vapor adsorbent chamber containing a fuel vapor adsorbing material disposed therein for adsorbing fuel vapor flowing thereto;

(2) a partition member extending partially into said fuel vapor adsorbent chamber from a top portion of said housing, wherein said fuel vapor adsorbent chamber is divided into a first compartment and a second compartment;

(3) a fuel vapor-receiving chamber disposed above said vapor adsorbent chamber for receiving fuel vapor having liquid fuel entrained therewith from said fuel tank;

(4) a first tubular member extending upwardly from said housing and in operable communication with said fuel vapor-receiving chamber, said first tubular member providing a passage through which said fuel vapor having said liquid fuel entrained therewith flows into said fuel vapor-receiving chamber;

(5) a first port in said housing, said first port providing open communication between said housing and said first tubular member;

(6) a second tubular member extending upwardly from said housing and in operable communication with said fuel-receiving chamber, said second tubular member providing a passage through which fuel vapor flows from said evaporative emissions canister to an automotive engine where said fuel vapor is consumed;

(7) a second port in said housing, said second port providing open communication between said fuel vapor receiving chamber and said second tubular member;

(8) a third tubular member extending upwardly from said housing, said third tubular member providing a passage through which fresh air is admitted to said housing during a purging, step and through which air from an air/fuel mixture is vented to the atmosphere in a venting step; and (9) a third port in said housing, said third port providing open communication between said fuel vapor adsorbent chamber and said third tubular member, and (b) a liquid-fuel trap disposed in said fuel vapor-receiving chamber above said fuel vapor adsorbent chamber, for separating said liquid fuel from said fuel vapor, wherein said liquid fuel trap is releasably installed in said housing by press fitting said fuel trap in the housing providing a seal sufficient to prevent said liquid fuel from passing to said fuel vapor adsorbent chamber.

2. The canister of claim 1 wherein said liquid fuel is received in said liquid-fuel trap and said fuel vapor is received in said adsorbent material contained in said adsorbent chamber.

3. The canister of claim 1 wherein said liquid fuel is received in said liquid fuel trap by gravity.

4. The canister of claim 1 wherein said fuel vapor adsorbing material comprises carbon.

5. The canister of claim 4 wherein said carbon is activated carbon.

6. The canister of claim 3 wherein said liquid fuel in said liquid fuel trap is subjected to evaporation, said evaporated liquid fuel and said described fuel vapor from said adsorbent material being directed to said automotive engine where said fuel vapors are consumed during a purge step.

7. The canister of claim 1 wherein said liquid-fuel trap comprises:

a bottom portion having a first surface, a second surface and an outer perimeter;

at least one side member integrally formed on said outer perimeter of said bottom portion, said at least one side portion defining a circumferential wall extending vertically from said bottom portion, said vertically extending wall having an inner surface and an outer surface, wherein said circumferential wall exhibits a uniform rim at a distal end thereof, said uniform rim configured to sealably engage a corresponding groove in an upper horizontal wall portion of said evaporative emissions canister forming a tortuous path for said liquid fuel, said bottom portion and said circumferential side portion of said liquid-fuel trap forming a housing for sealably collecting and isolating said liquid fuel therein, thereby preventing said liquid fuel from entering said adsorbent chamber;

an aperture centrally located in said bottom portion of said liquid-fuel trap housing;

a tubular member formed on said first surface integrally with and extending upwardly from said aperture in said bottom portion of said liquid-fuel trap housing forming open communication between said liquid-fuel trap housing and said adsorbent chamber whereby fuel vapor flows there between;

a plurality of protrusions formed evenly over an outer surface of said bottom portion of said liquid-fuel trap, said plurality of finger elements extending downwardly from said second surface of said bottom portion of said fuel-trap housing; and a plurality of spaced apart vertical rib members integrally formed on at least a portion of said outer surface of said vertical side portion, said plurality of spaced apart rib members exerting sufficient pressure against an inner surface of said evaporative emissions canister to secure said liquid-fuel trap housing in said evaporative emissions canister and provide a tortuous path for said liquid fuel.

8. The canister of claim 7 wherein said liquid fuel trap further comprising:

a porous barrier member disposed between said outer surface of said bottom portion of said liquid-fuel trap and said adsorbent chamber, wherein said porous barrier member enhances flow of said fuel vapor from said liquid-fuel trap to said adsorbent chamber, wherein said plurality of finger elements exhibit a surface structure for maintaining said porous barrier member in a relatively flat configuration against said bottom portion of said liquid-fuel trap.

9. The canister of claim 1, wherein said evaporative emissions canister is molded as a unitary structure from a polymeric material exhibiting sufficient flexibility, fuel resistance, heat resistance, pressure resistance, weatherability, dimensional stability, and high impact strength to withstand a harsh environment associated with an automotive evaporative emissions system.

10. The canister of claim 9 wherein said evaporative emissions canister is molded from a polyamide selected from the group consisting of nylon and aramid.

11. A liquid-fuel trap configured to be disposed above a vapor absorbing chamber in an evaporative emissions canister, wherein said liquid-fuel trap is releasably mounted in said evaporative canister by pressure fit installation, wherein said liquid-fuel trap is effective to separate liquid fuel from fuel vapor store said liquid fuel until evaporation of said liquid fuel pass said fuel vapor in a uniform distribution manner to a vapor adsorbing chamber where said fuel vapor is absorbed until a purging stage is activated, wherein said fuel vapor and said evaporated liquid fuel are purged to an automotive engine where said fuel vapor and said evaporated liquid fuel are consumed, said liquid-fuel trap comprising:

a bottom portion having a first surface, a second surface and an outer perimeter;

at least one side member integrally formed on said outer perimeter of said bottom portion, said at least one side portion defining a circumferential wall extending vertically from said bottom portion, said vertically extending wall having an inner surface and an outer surface, wherein said circumferential wall exhibits a uniform rim at a distal end thereof, said uniform rim configured to sealably engage a corresponding groove in an upper horizontal wall portion of said evaporative emissions canister forming a tortuous path for said liquid fuel, said bottom portion and said circumferential side portion of said liquid-fuel trap forming a housing for sealably collecting and isolating said liquid fuel therein, thereby preventing said liquid fuel from entering said adsorbent chamber;

an aperture centrally located in said bottom portion of said liquid-fuel trap housing;

a tubular member formed on said first surface integrally with and extending upwardly from said aperture in said bottom portion of said liquid-fuel trap housing forming open communication between said liquid-fuel trap housing and said adsorbent chamber whereby fuel vapor flows there between;

a plurality of finger elements formed evenly over an outer surface of said bottom portion of said liquid-fuel trap, said plurality of finger elements extending downwardly from said second surface of said bottom portion of said fuel-trap housing; and a plurality of spaced apart vertical rib members integrally formed on at least a portion of said outer surface of said vertical side portion, said plurality of spaced apart rib members exerting sufficient pressure against an inner surface of said evaporative emissions canister to secure said liquid-fuel trap housing in said evaporative emissions canister and provide a tortuous path for said liquid fuel.

12. The liquid-fuel trap of claim 11 further including: a porous barrier member disposed between said outer surface of said bottom portion of said liquid-fuel trap and said adsorbent chamber, wherein said porous barrier member enhances flow of said fuel vapor from said liquid-fuel trap to said adsorbent chamber, wherein said plurality of finger elements exhibit a surface structure for maintaining said porous barrier member in a relatively flat configuration against said bottom portion of said liquid-fuel trap.

13. A method for separating liquid fuel from fuel vapor in an evaporative emissions canister, said method comprising:

(a) providing an evaporative emissions canister comprising (1) a housing having a circumferential sidewall, a top wall and a bottom wall:

(2) a fuel vapor adsorbent chamber containing a hydrocarbon vapor adsorbing material disposed therein for adsorbing hydrocarbon fuel vapor flowing thereto;

(3) a fuel vapor-receiving chamber disposed above said vapor adsorbent chamber for receiving fuel vapor having liquid fuel entrained therewith;

(4) a first tubular member extending upwardly from said housing and in operable communication with said fuel vapor-receiving chamber, said first tubular member providing a passage through which said fuel vapor having said liquid fuel entrained therewith flows into said fuel vapor-receiving chamber;

(5) a first port in said housing, said first port providing open communication between said fuel-receiving chamber and said first tubular member;

(6) a second tubular member extending upwardly from said housing and in operable communication with said fuel-receiving chamber, said second tubular member providing a passage through which fuel vapor flows from said evaporative emissions canister to an automotive engine where said fuel vapor is consumed;

(7) a second port in said housing, said second port providing open communication between said fuel-receiving chamber and said second tubular member;

(8) a third tubular member extending upwardly from said housing, said third tubular member providing a passage through which fresh air is admitted to said adsorbent chamber during a purging step, and through which air from an air/fuel mixture is vented from said adsorbent chamber to the atmosphere in a venting step; and (9) a third port in said housing, said third port providing open communication between said adsorbent chamber and said third tubular member, and (b) providing a liquid-fuel trap for separating liquid fuel from said fuel vapor, and (c) releasably installing said liquid fuel trap in said fuel vapor receiving chamber by press fitting said fuel trap into said fuel vapor receiving chamber forming a seal therein sufficient to provide a tortuous path to prevent said liquid fuel from passing into said adsorbent chamber.

14. The method of claim 13 wherein said liquid fuel is received in said liquid-fuel trap by gravity and remains in said liquid fuel trap until evaporated while said fuel vapor passes to said adsorbent material contained in said adsorbent chamber.

15. The method of claim 13 wherein said fuel vapor adsorbing material comprises carbon.

16. The method of claim 15 wherein said carbon is activated carbon.

17. The canister of claim 13 wherein said liquid fuel in said liquid fuel trap is subjected to evaporation.

18. The method of claim 17 wherein the evaporated liquid fuel and fuel vapor from said adsorbent chamber is directed to said automotive engine during a purge stage.

19. The method of claim 13, wherein said evaporative emissions canister is molded as a unitary structure from a polymeric material exhibiting sufficient flexibility, fuel resistance, heat resistance, pressure resistance, weatherability, dimensional stability, and high impact strength to withstand a harsh environment associated with an automotive evaporative emissions system.

20. The method of claim 19 wherein said evaporative emissions canister is molded from a polyamide selected from the group consisting of nylon and aramid.

21. The method of claim 13 wherein said liquid-fuel trap is molded as a unitary structure from a polymeric material exhibiting sufficient flexibility, fuel resistance, heat resistance, pressure resistance, weatherbility, dimensional stability, and high impact strength to withstand a harsh environment associated with an automotive evaporative emissions system.

22. The method of claim 21 wherein said liquid-fuel trap is molded from a polyamide selected from the group consisting of nylon and aramid.

23. The liquid fuel trap of claim 11, wherein said liquid-fuel trap housing is molded as a unitary structure from a polymeric material exhibiting sufficient flexibility, fuel resistance, heat resistance, pressure resistance, weatherability, dimensional stability, and high impact strength to withstand a harsh environment associated with an automotive evaporative emissions system.

24. The liquid fuel trap of claim 23 wherein said liquid-fuel trap housing is molded from a polyamide selected from the group consisting of nylon and aramid.

* * * * *